US009723924B1

(12) United States Patent
Chiu

(10) Patent No.: US 9,723,924 B1
(45) Date of Patent: Aug. 8, 2017

(54) BRACKET ASSEMBLY

(71) Applicant: Nan Juen International Co., Ltd., New Taipei (TW)

(72) Inventor: I-Hsiang Chiu, New Taipei (TW)

(73) Assignee: Nan Juen International Co., Ltd., New Taipei (TW)

( * ) Notice: Subject to any disclaimer, the term of this patent is extended or adjusted under 35 U.S.C. 154(b) by 0 days.

(21) Appl. No.: 15/224,648

(22) Filed: Jul. 31, 2016

(30) Foreign Application Priority Data

Jun. 6, 2016 (TW) ..... 105117859 A

(51) Int. Cl.
*A47B 96/06* (2006.01)
*A47B 88/04* (2006.01)

(52) U.S. Cl.
CPC ..... *A47B 88/044* (2013.01)

(58) Field of Classification Search
USPC ..... 248/219.3
See application file for complete search history.

(56) References Cited

U.S. PATENT DOCUMENTS 7,703,734 B2 * 4/2010 Chen ..... A47B 88/43 108/108
7,950,753 B2 * 5/2011 Liang ..... A47B 88/43 211/26
8,408,506 B2 * 4/2013 Yu ..... A47B 88/43 248/219.1
8,550,416 B2 * 10/2013 Yu ..... H05K 7/1489 248/241
8,870,311 B2 * 10/2014 Chang ..... H05K 7/183 312/334.4
9,532,483 B1 * 12/2016 Chang ..... F16B 2/12
2012/0292928 A1 * 11/2012 Chang ..... H05K 7/1489 292/273
2014/0363109 A1 * 12/2014 Chen ..... A47B 88/044 384/22
2016/0324317 A1 * 11/2016 Chen ..... H05K 7/1489
2017/0042328 A1 * 2/2017 Chen ..... A47B 88/044
2017/0055707 A1 * 3/2017 Chen ..... A47B 88/0407
2017/0095079 A1 * 4/2017 Chen ..... H05K 7/1489
2017/0099946 A1 * 4/2017 Chen ..... A47B 88/16
2017/0112016 A1 * 4/2017 Chen ..... A47B 88/044

* cited by examiner

*Primary Examiner* — Monica Millner

(57) ABSTRACT

A bracket assembly includes a bracket and a positioning mechanism affixed to the bracket for mounting. The positioning mechanism includes a fixed block unit including a locating block and first mounting posts extended from the locating block, and a movable block unit including hollow second mounting posts of a different cross section relative to the first mounting posts and insertable through the locating block and movable relative to the fixed block between a forward position where the second mounting posts respectively protrude over the respective distal ends of the first mounting posts for fastening to respective mounting through holes of a support frame in a cabinet of a machine and a backward position where the second mounting posts are retracted and received inside the locating block to let the first mounting posts be exposed to the outside for fastening to respective mounting through holes of another design of support frame.

5 Claims, 11 Drawing Sheets

BRACKET ASSEMBLY

BACKGROUND OF THE INVENTION

1. Field of the Invention

The present invention relates to bracket designs for fastening to support frames in a cabinet of a machine to support a sliding rail and more particularly, to a bracket assembly, which is adjustable to fit different configurations of mounting through holes of different design of support frames.

2. Description of the Related Art

Brackets are commonly used for mounting in a cabinet of a machine to support sliding rails. In order to facilitate bracket dismounting without tools, brackets for this purpose are configured to provide mounting posts that can be detachably fastened to respective mounting through holes of mating support frames in a cabinet of a machine. However, because the mounting through holes of different designs of support frames from different manufacturers have different configurations, different brackets with different configurations of mounting posts should be selectively used. Brackets with multi-segment mounting posts are created. The multi-segment mounting posts can be into different configurations of mounting through holes to force different segments thereof into friction engagement with different configurations of mounting through holes. However, due to insufficient bearing surface area between the respective segments of the multi-segment mounting posts and the respective mounting through holes, the brackets are less stable after installation.

SUMMARY OF THE INVENTION

The present invention has been accomplished under the circumstances in view. It is therefore the main object of the present invention to provide a bracelet assembly, which is adjustable to fit different configurations of mounting through holes of different designs of support frames.

To achieve this and other objects of the present invention, a bracket assembly comprises a bracket and a positioning mechanism. The bracket comprises a base frame. The positioning mechanism comprises a fixed block unit and a movable block unit. The fixed block unit comprises a locating block fixedly mounted on the base frame of the bracket and defining a front side and a back side opposite to the front side, and a plurality of first mounting posts respectively extended from the front side of the locating block in a parallel manner. The movable block unit comprises a base block coupled to the locating block and axially movable relative to the locating block between a forward position and a backward position, and a plurality of second mounting posts respectively extended from the base block and respectively disposed in axial alignment with the first mounting posts and insertable through the back side and front side of the locating block of the fixed block unit to surround the respective first mounting posts. The first mounting posts and the second mounting posts have different cross sections. When the base block of the movable block unit of the positioning mechanism is moved to the forward position, the second mounting posts are extended out of the front side of the locating block around the respective first mounting posts and protruded over respective distal ends of the respective first mounting posts. On the contrary, when the base block of the movable block unit of the positioning mechanism is moved to from the forward position to the backward position, the second mounting posts are received inside the locating block to let the first mounting posts be exposed outside the locating block and the movable block unit for mounting. Thus, the user can selectively use the first mounting posts or the second mounting posts for fastening the bracket assembly to different configurations of mounting through holes of different designs of support frames.

DETAILED DESCRIPTION OF THE PREFERRED EMBODIMENT

Figure 1:
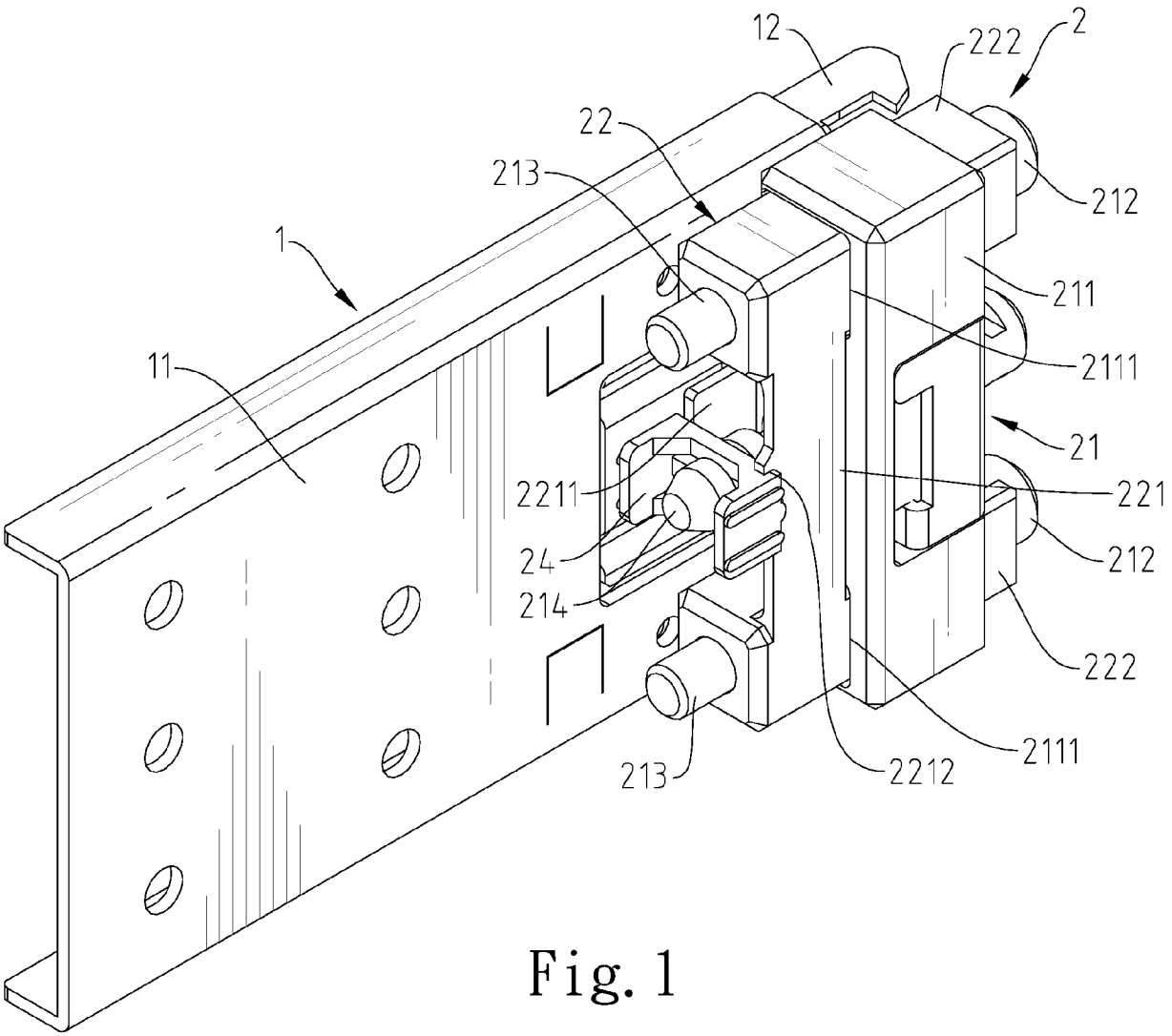
FIG. 1 is an oblique top elevational view of a bracket assembly in accordance with the present invention.
Figure 2:
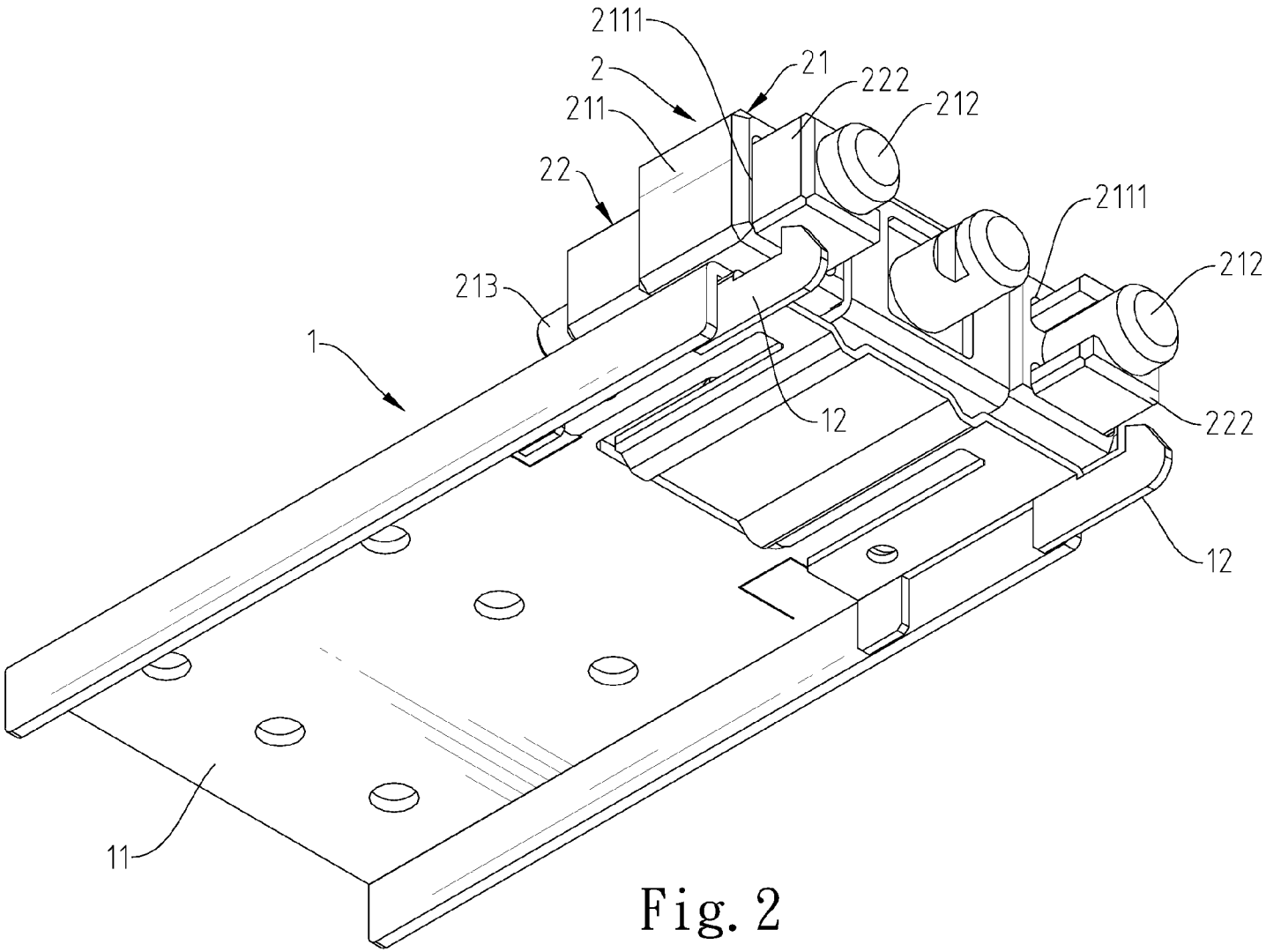
FIG. 2 corresponds to FIG. 1 when viewed from another angle.
Figure 3:
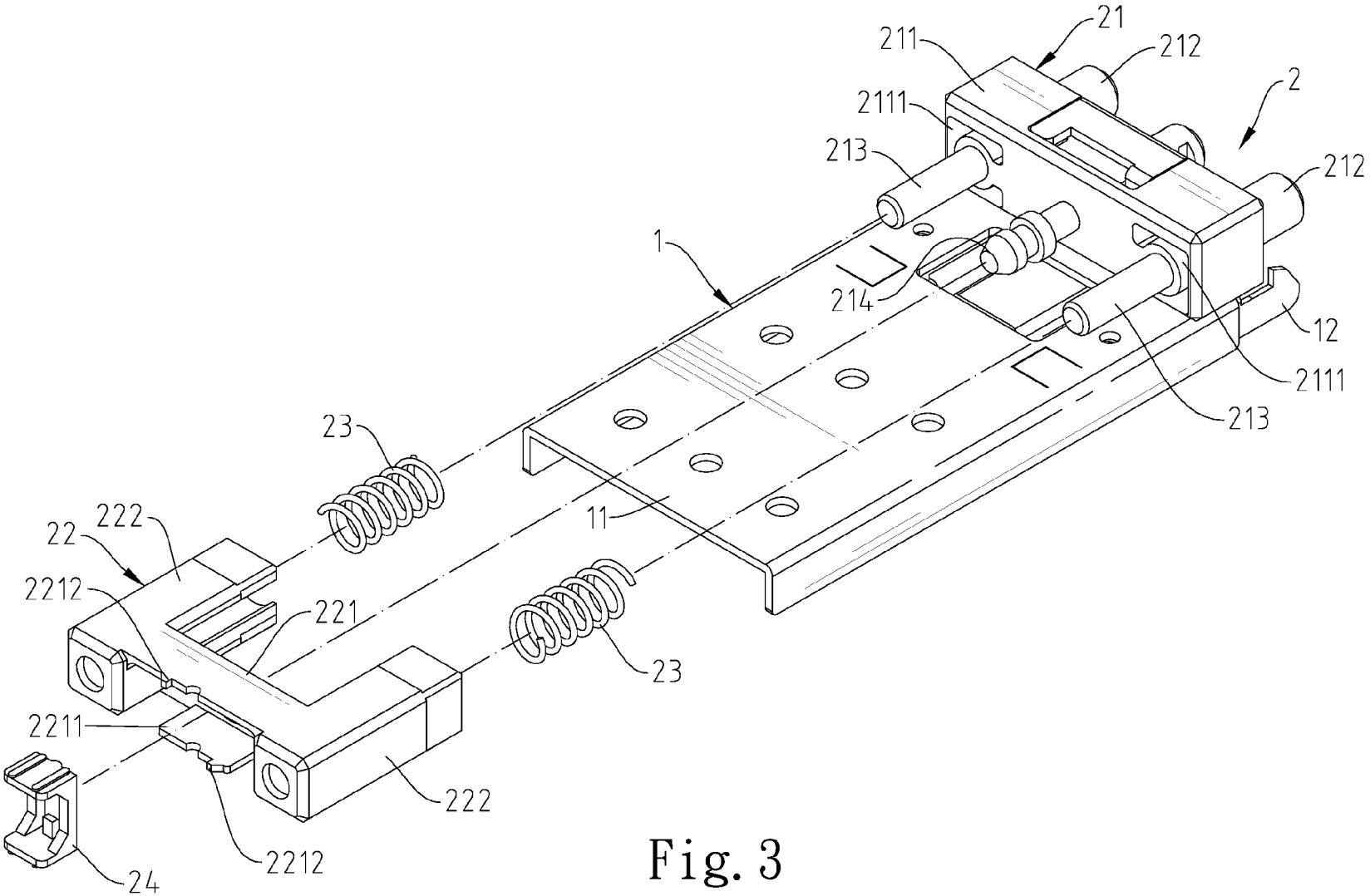
FIG. 3 is an exploded view of the positioning mechanism of the bracket assembly in accordance with the present invention.

Referring to FIGS. 1-3 and FIG. 5, a bracket assembly in accordance with the present invention is shown. The bracket assembly comprises a bracket 1 and a positioning mechanism 2.

The bracket 1 comprises a base frame 11, and at least one, for example, two hook members 12 bilaterally extended from one end of the base frame 11.

The positioning mechanism 2 comprises a fixed block unit 21 and a movable block unit 22. The fixed block unit 21 comprises a locating block 211 fixedly mounted on one end of a top wall of the base frame 11 of the bracket 1, and a plurality of first mounting posts 212 extended from one side, namely, the front side of the locating block 211 in a parallel manner. The movable block unit 22 comprises a base block 221, two second mounting posts 222 located at two opposite sides of the base block 221 and respectively disposed in axial alignment with the first mounting posts 212. The base block 221 is connected to an opposite side, namely, the back side of the locating block 211. The locating block 211 comprises two insertion slots 2111 adapted for receiving the respective second mounting posts 222. The second mounting posts 222 are hollow posts. The insertion slots 2111 and the second mounting posts 222 have the same cross section so that the second mounting posts 222 can be inserted through the locating block 211 to surround the respective first mounting posts 212. Further, the first mounting posts 212 and the second mounting posts 222 have different outer configurations. In this embodiment, the first mounting posts 212 are round posts. The second mounting post 222 are hollow rectangular posts. The fixed block unit 21 further comprises two guide rods 213 extended from the back side of the locating block 211 and respectively in axial alignment with the first mounting posts 212, and a position-limiting post 214 extended from the back side of the locating block 211 and equally spaced between the two guide rods 213 in a parallel manner. The bracket assembly further comprises two spring members 23 respectively mounted around the guide rods 213 and positioned in the respective second mounting posts 222 with respective opposite ends thereof respectively stopped against the locating block 211 and respective inside walls of the second mounting posts 222, and a constraint member 24 pivotally connected to the position-limiting post 214 to let the base block 221 of the movable block unit 22 be disposed between the constraint member 24 and the locating block 211. The base block 221 of the movable block unit 22 comprises an accommodation open chamber 2211 adjacent to the position-limiting post 214 for accommodating the constraint member 24, and two stopper protrusions 2212 respectively disposed at opposing top and bottom sides relative to the accommodation open chamber 2211 for stopping against the constraint member 24.

Figure 4:
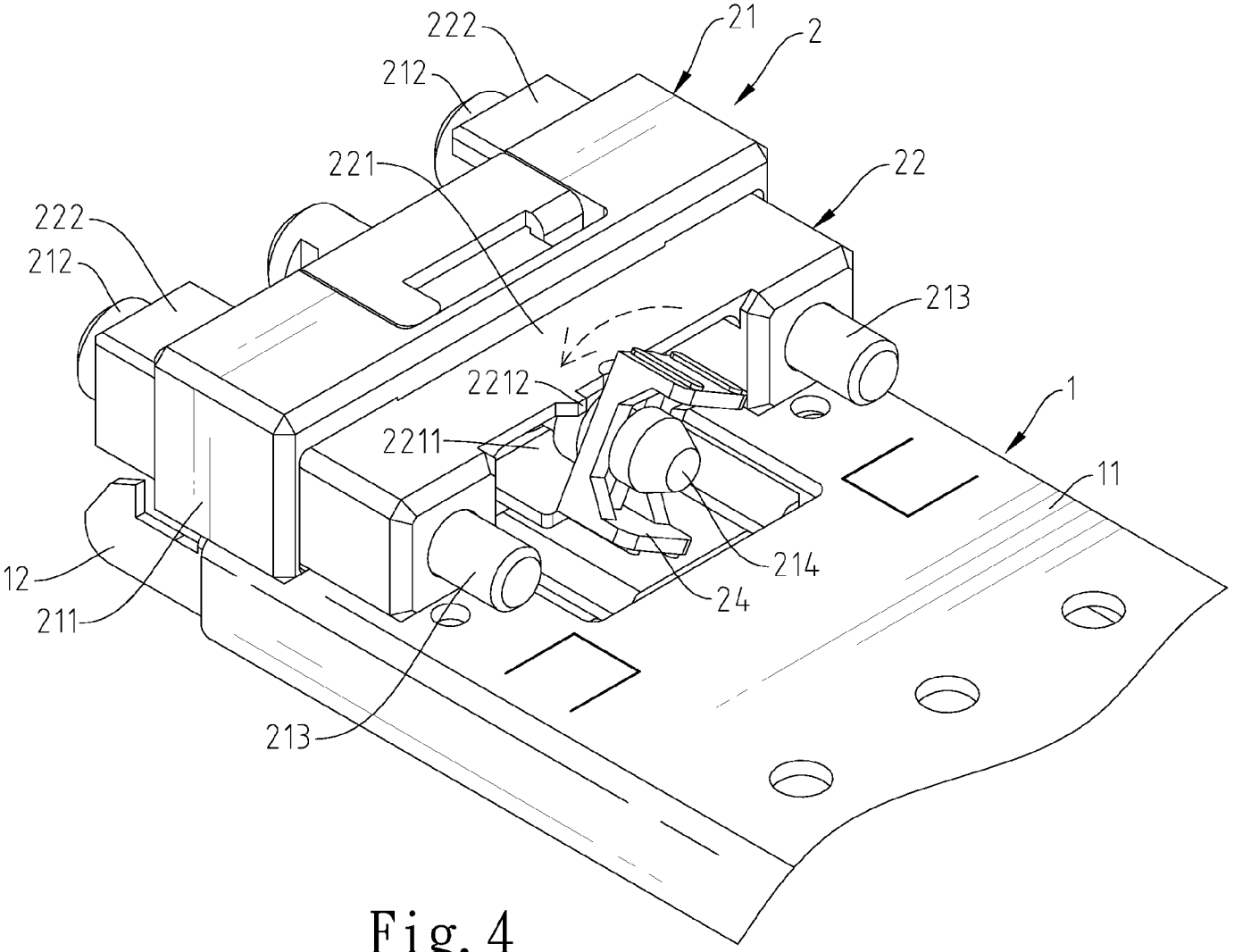
FIG. 4 is a schematic drawing of the present invention, illustrating the movable block unit in the forward position in proximity to the fixed block unit and the constraint member biased relative to the position-limiting post from horizontal to vertical and stopped outside the base block of the movable block unit.
Figure 5:
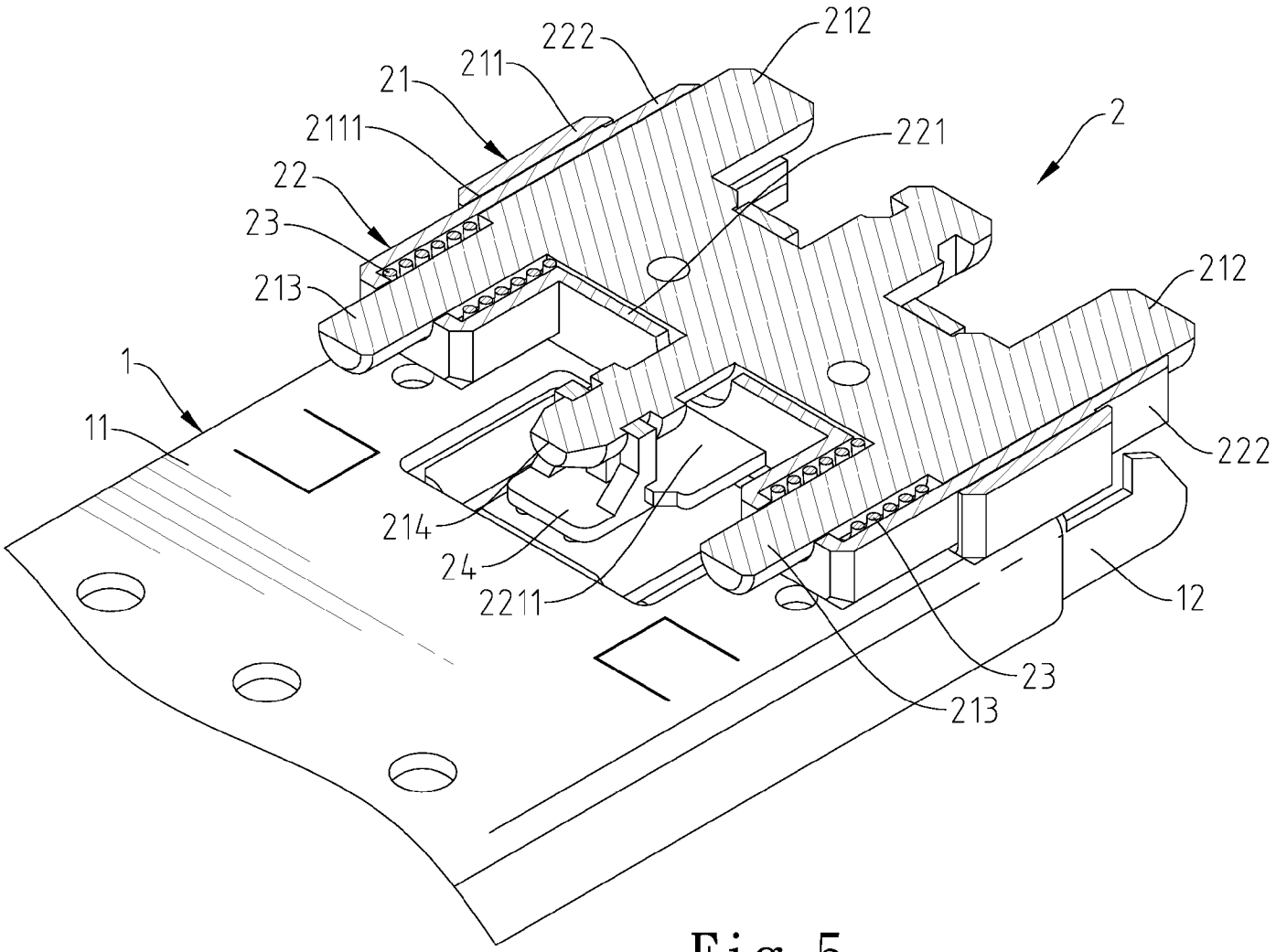
FIG. 5 is a sectional elevational view of a part of the bracket assembly in accordance with the present invention, illustrating the movable block unit stopped in the forward position.
Figure 6:
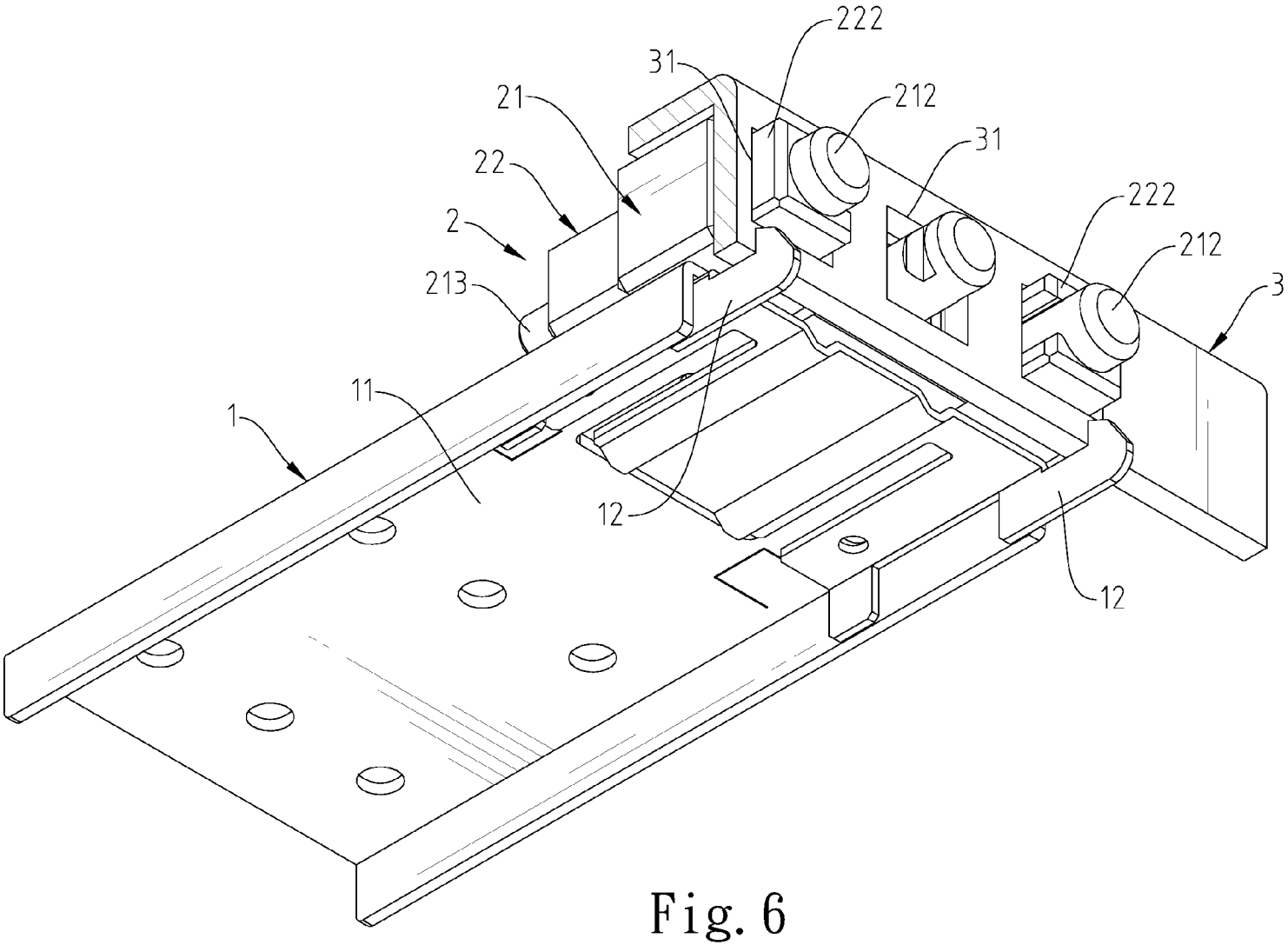
FIG. 6 is an oblique bottom elevational view illustrating the second mounting posts extended out of the front side of the locating block and fastened to respective rectangular mounting through holes of a support frame.
Figure 7:
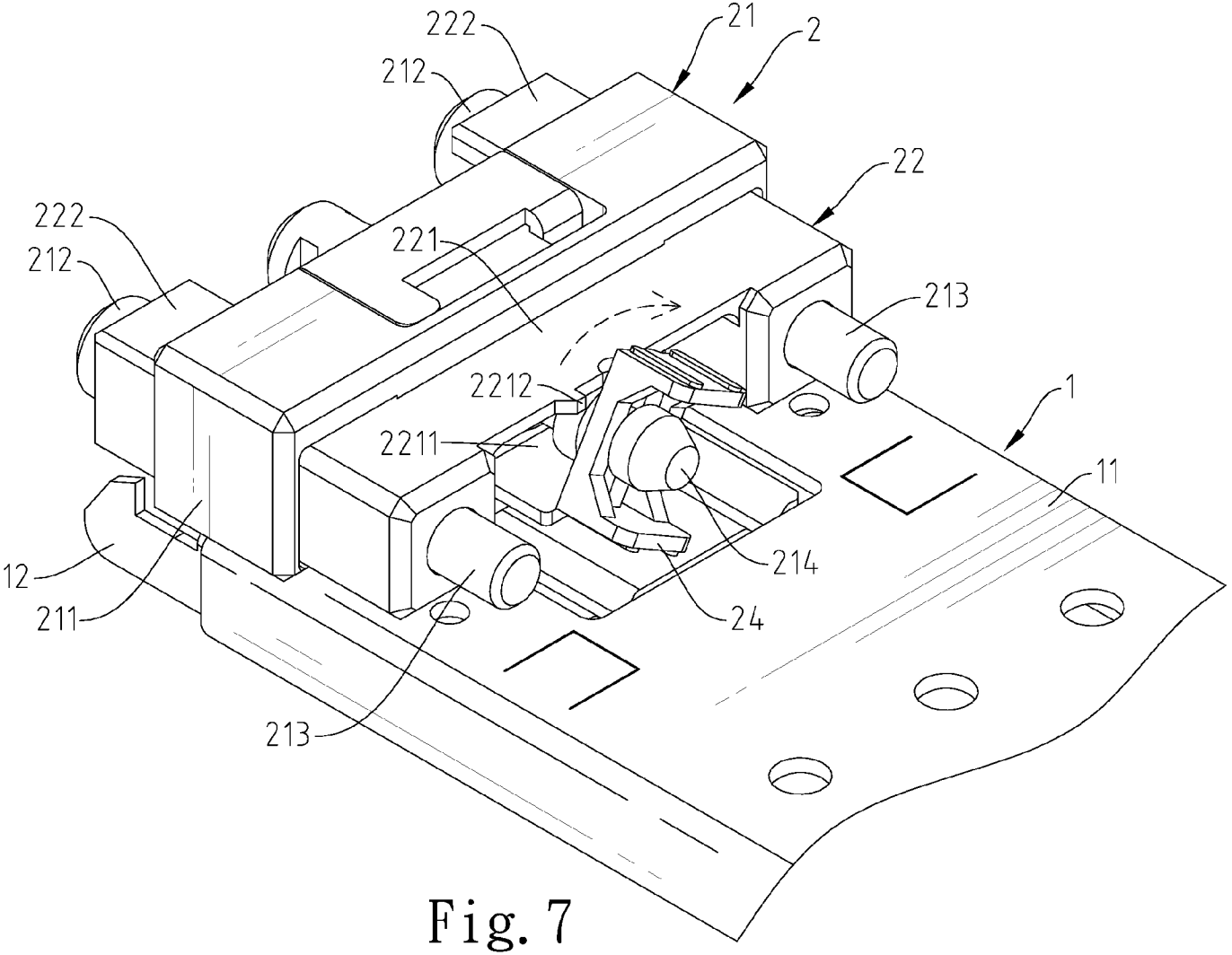
FIG. 7 is similar to FIG. 4, illustrating the constraint member biased in reversed direction relative to the position-limiting post from vertical to horizontal.
Figure 8:
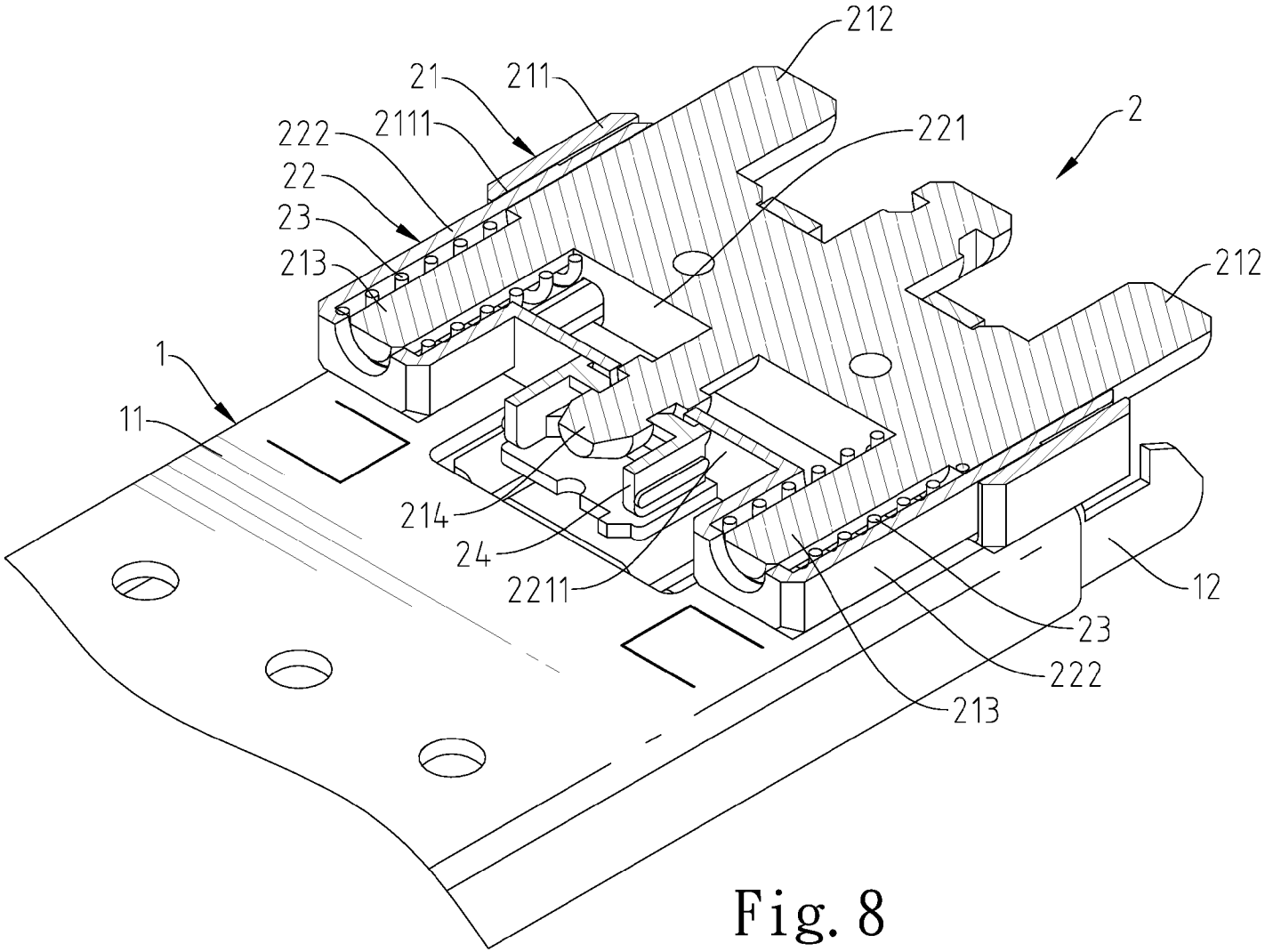
FIG. 8 is similar to FIG. 5, illustrating the movable block unit disposed in the backward position and the first mounting posts exposed to the outside for mounting.
Figure 9:
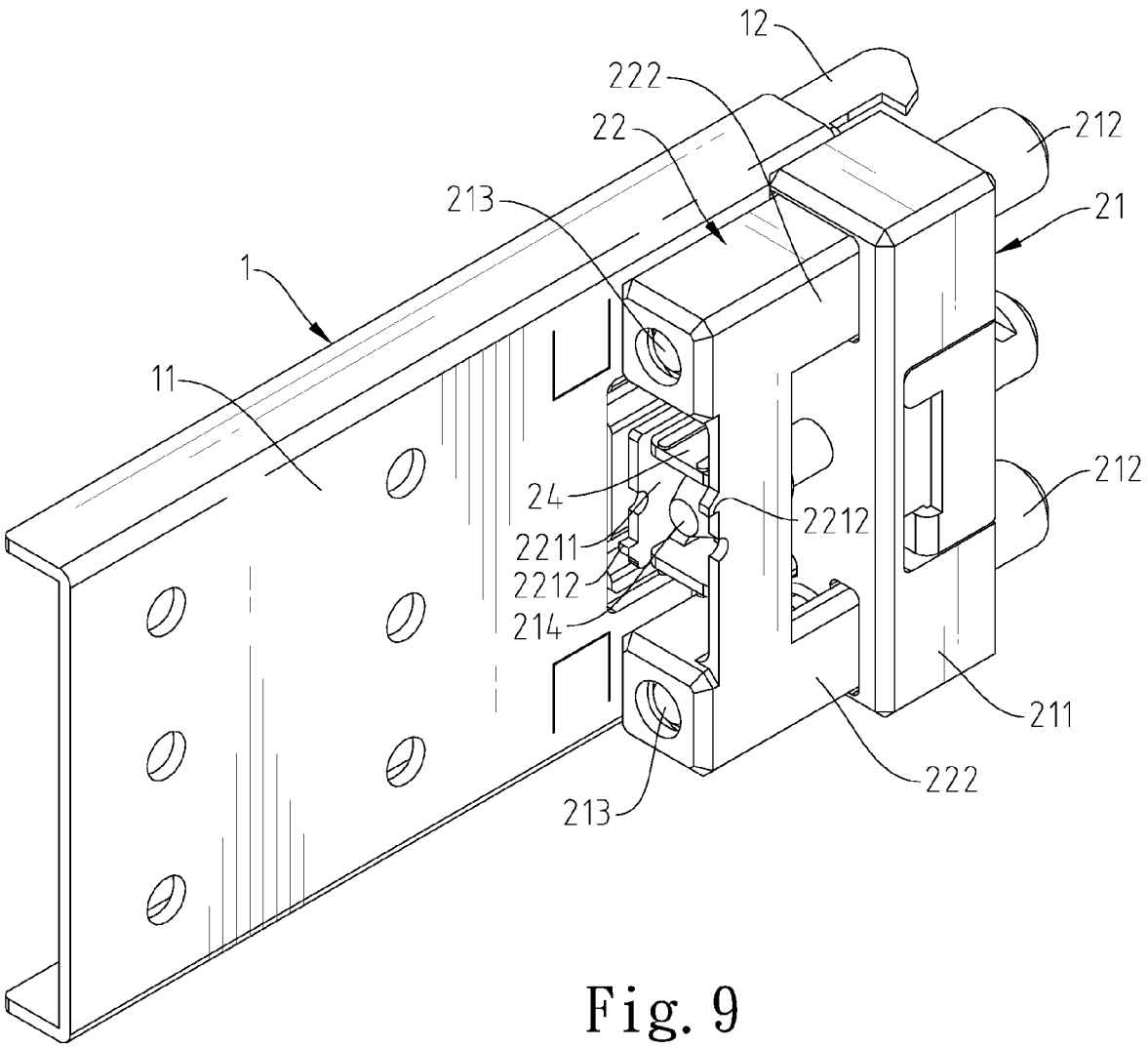
FIG. 9 is an oblique top elevational view of the present invention, illustrating the movable block unit disposed in the backward position and the first mounting posts exposed to the outside for mounting.
Figure 10:
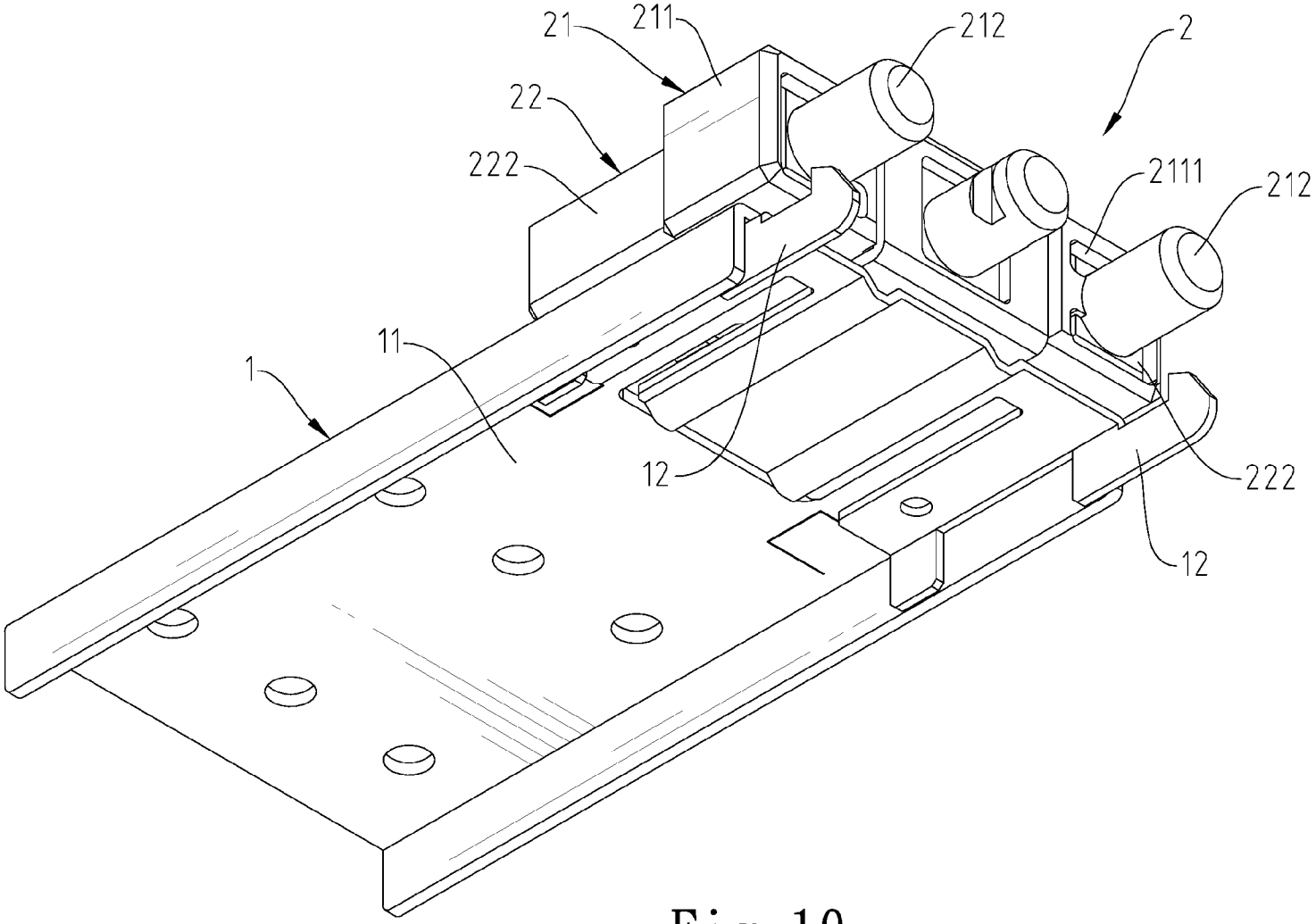
FIG. 10 corresponds to FIG. 9 when viewed from another angle.

Referring to FIGS. 4-6, when mounting the bracket assembly of the present invention in a support frame 3 (in a cabinet of a machine), the bracket assembly must be adjusted according to the configuration of the mounting through holes 31 of the support frame 3. In the case that the mounting through holes 31 of the support frame 3 are rectangular holes, as illustrated in FIG. 6, the user can move the base block 221 of the movable block unit 22 toward the locating block 211 from a backward position to a forward position to push the second mounting posts 222 out of the front side of the locating block 211 around the respective first mounting posts 212. At this time, the second mounting posts 222 respectively protrude over the respective distal ends of the first mounting posts 212 and the constraint member 24 is exposed outside the accommodation open chamber 2211, thus, the user can then bias the constraint member 24 through about a 90-degrees angle from a horizontal position to a vertical position, enabling the constraint member 24 to be stopped at the outer surface of the base block 221 outside the accommodation open chamber 2211 to hold the base block 221 firmly in the forward position in proximity to the locating block 211, allowing the second mounting posts 222 to be respectively press-fitted into the respective rectangular mounting through holes 31 of the support frame 3.

Figure 11:
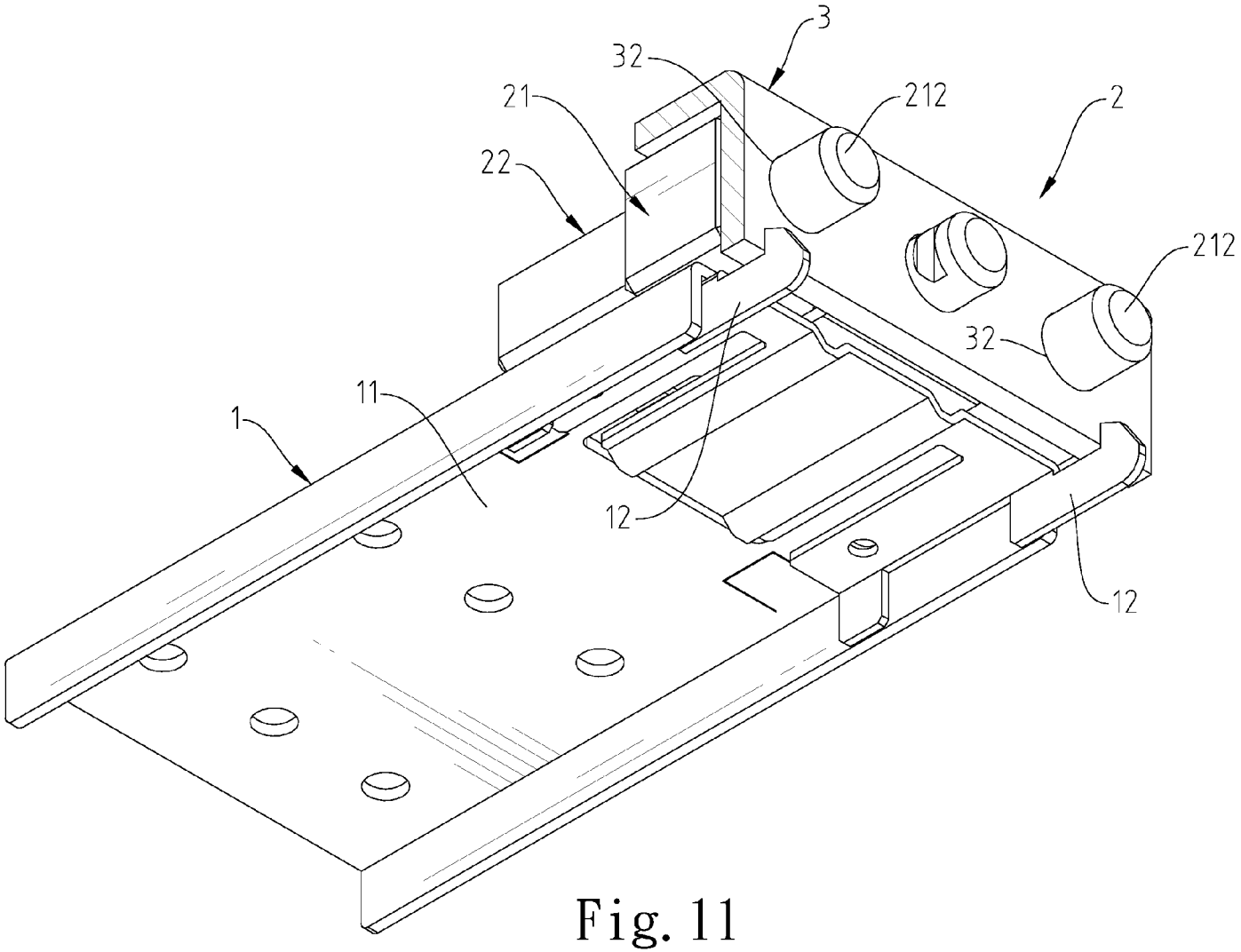
FIG. 11 is an oblique bottom elevational view illustrating the movable block unit disposed in the backward position and the first mounting fastened to respective circular mounting through holes of a support frame.

Referring to FIGS. 7-11, if the user wishes to use the first mounting posts 212 of the positioning mechanism 2 for mounting in a support frame 3 of which the mounting through holes 31 are circular holes, the user can bias the constraint member 24 through about a 90-degrees angle from the vertical position to the horizontal position to keep the constraint member 24 in horizontal alignment with the accommodation open chamber 2211. At this time, the elastic potential energy of the spring members 23 forces the movable block unit 22 in direction away from the locating block 211 from the forward position to the backward position to retract the second mounting posts 222 from the locating block 211 and to let the first mounting posts 212 be exposed to the outside, as illustrated in FIG. 11, allowing the first mounting posts 212 to be respectively press-fitted in the respective circular mounting through holes 32 of the support frame 3.

What the invention claimed is:

1. A bracket assembly, comprising:

a bracket comprising a base frame;

a positioning mechanism comprising a fixed block unit and a movable block unit, said fixed block unit comprising a locating block fixedly mounted on said base frame of said bracket and defining a front side and a back side opposite to said front side and a plurality of first mounting posts respectively extended from said front side of said locating block in a parallel manner, said movable block unit comprising a base block coupled to said locating block and axially movable relative to said locating block between a forward position and a backward position and a plurality of second mounting posts respectively extended from said base block and respectively disposed in axial alignment with said first mounting posts and insertable through the back side and front side of said locating block of said fixed block unit to surround the respective said first mounting posts, said first mounting posts and said second mounting posts have different cross sections;

wherein when said base block of said movable block unit of said positioning mechanism is moved to said forward position, said second mounting posts are extended out of the said front side of said locating block around the respective said first mounting posts and protruded over respective distal ends of the respective said first mounting posts; when said base block of said movable block unit of said positioning mechanism is moved to from said forward position to said backward position, said second mounting posts are received inside said locating block to let said first mounting posts be exposed outside said locating block and said movable block unit for mounting.

2. The bracket assembly as claimed in claim 1, wherein said base block of said positioning mechanism comprises a plurality of insertion slots cut through the opposing front and back sides thereof around the respective said first mounting posts for the passing of the respective said second mounting posts, said insertion slots and said second mounting post having the same cross section.

3. The bracket assembly as claimed in claim 1, wherein said fixed block unit further comprises a plurality of guide rods extended from the said front side of said locating block and respectively disposed in axial alignment with the respective said first mounting posts; said positioning mechanism further comprises a plurality of spring members respectively mounted around said guide rods and respectively received inside said second mounting posts and respectively stopped between the said front side of said locating block and respective inside walls of said second mounting posts to impart an elastical potential energy to said movable block unit so as to constantly support said movable block unit in said backward position.

4. The bracket assembly as claimed in claim 1, wherein said base block of said movable block unit defines therein an accommodation open chamber; said positioning mechanism further comprises a position-limiting post extended from the said front side of said locating block at the center in a parallel manner relative to said guide rods and inserted through said accommodation open chamber, and a constraint member pivotally connected to said position-limiting post in such a manner that said base block of said movable block unit is disposed between said constraint member and said locating block, said constraint member being biasable relative to said position-limiting post between a horizontal position where said constraint member is receivable in said accommodation open chamber for enabling said movable block unit to be moved to said backward position and a vertical position where said constraint member is stopped outside said base block to hold said movable block unit in said forward position.

5. The bracket assembly as claimed in claim 4, wherein said base block of said movable block unit comprises a plurality of stopper protrusions respectively located at opposing top and bottom sides relative to said accommodation open chamber for stopping said constraint member outside said base block.

* * * * *